US006737969B2

(12) United States Patent
Carlson et al.

(10) Patent No.: US 6,737,969 B2
(45) Date of Patent: May 18, 2004

(54) WIRELESS SECURITY SENSOR SYSTEMS FOR WINDOWS AND DOORS

(75) Inventors: Julian Carlson, Blaine, WA (US); Dean David Schebel, Port Coquitlam (CA)

(73) Assignee: Ion Digital LLP, Blaine, WA (US)

( * ) Notice: Subject to any disclaimer, the term of this patent is extended or adjusted under 35 U.S.C. 154(b) by 29 days.

(21) Appl. No.: 09/994,048

(22) Filed: Nov. 27, 2001

(65) Prior Publication Data

US 2003/0098791 A1 May 29, 2003

(51) Int. Cl.[7] ..... G08B 13/03

(52) U.S. Cl. ..... 340/547; 340/545.4; 340/545.6; 340/528; 340/539.1; 340/551

(58) Field of Search ..... 340/547, 545.4, 340/528, 545.6, 539.1, 551

(56) References Cited

U.S. PATENT DOCUMENTS

| | | | | |
|---|---|---|---|---|
| 3,696,359 A | * | 10/1972 | Ross et al. | 340/539 |
| 4,209,777 A | * | 6/1980 | Morrison | 340/547 |
| 4,855,713 A | | 8/1989 | Brunius | |
| 4,864,636 A | | 9/1989 | Brunius | |
| 5,003,747 A | * | 4/1991 | Morton | 52/656.5 |
| 5,007,199 A | * | 4/1991 | Dunagan et al. | 49/13 |
| 5,164,705 A | | 11/1992 | Dunagan et al. | |
| 5,712,621 A | * | 1/1998 | Andersen | 340/547 |
| 5,761,206 A | | 6/1998 | Kackman | |
| 5,805,063 A | | 9/1998 | Kackman | |
| 5,809,013 A | | 9/1998 | Kackman | |
| 5,872,512 A | | 2/1999 | Kackman et al. | |
| 5,942,981 A | | 8/1999 | Kackman | |

FOREIGN PATENT DOCUMENTS

| | | |
|---|---|---|
| DE | 20017433 | 3/2001 |
| GB | 2356077 | 5/2001 |
| NL | 1000644 | 12/1996 |

OTHER PUBLICATIONS

Interactive Technologies, Inc., "Recessed Micro Door/Window Sensor", 2000.

Apr. 1998 Ademco (Alarm Device Manufacturing Company, a division of Pittway Corporation, Syosset, NY) installation instructions to its recessed transmitter model No. 5818.

* cited by examiner

*Primary Examiner*—Daniel J. Wu
*Assistant Examiner*—Tai T. Nguyen
(74) *Attorney, Agent, or Firm*—Kathleen T. Petrich

(57) ABSTRACT

An wireless security sensor system includes a window frame defining a window opening, a window sash movable relative to the window frame between open and closed positions; and a sensor unit embedded in the window frame. The sensor unit includes a housing having an inner end within the window frame, an outer end at a surface of the window frame and a flexible ¼ wave wire antenna extending e.g. longitudinally of the window frame from the housing. The housing contains a sensor switch, a microprocessor, and RF transmitter and a battery for emitting signals to a master station or controller and the wireless security sensor system includes a magnet mounted in the window sash for actuating the sensor switch. The window frame is made from a plastics material extrusion having a hollow interior and the housing has a peripheral flange at the outer end thereof which is seated on the surface of the window frame.

13 Claims, 7 Drawing Sheets

WIRELESS SECURITY SENSOR SYSTEMS FOR WINDOWS AND DOORS

BACKGROUND OF THE INVENTION

1. Field of the Invention

The present invention relates to wireless security sensor systems and, more particularly, to wireless security sensor systems, for installation in doors and/or windows, of the type employing RF transmitters for emitting radio frequency signals.

2. Description of the Related Art

Wireless security systems allow a residence or business to be monitored without a need for extensive wiring throughout the residence or building, and therefore have the advantages that they require lower installation costs and lower product costs and provide an easier upgrade path for possible future improvements than prior systems requiring such wiring.

Prior wireless security sensor systems communicate a disturbance to a master station or a controller and monitor, typically located within the same building as the wireless security system, on a common radio frequency and usually comprise a housing containing a battery, a microprocessor, an RF transmitter and an antenna. These prior systems are designed to be installed into a building after the construction of the building has been completed, by being mounted on the surface of a window sash or door or by drilling into a door or door frame.

In order to provide a sufficient transmission range, to report reliably to the master station or controller, the components within the housing, and in particular the antenna, must be of sufficient size. Consequently, the housing is bulky and, when surface mounted, is clearly and unattractively visible. When a sufficiently lengthy hole is required to be drilled into a door frame to accommodate the housing, there is a risk of defects such as water damage.

BRIEF SUMMARY OF THE INVENTION

It is accordingly an object of the present invention to provide an improved wireless security sensor system employing a sensor unit having a substantially more compact housing than has previously been possible and which, therefore, presents a substantially less intrusive appearance than prior alarm sensor units.

According to the present invention, there is provided an wireless security sensor system which comprises a frame defining a opening, with closure movable relative to the frame between open and closed positions. A sensor unit is embedded in the frame comprises and a housing having an inner end within the frame, an outer end at the opening and an antenna extending from the housing at the exterior of the housing. The housing also contains a sensor switch, a microprocessor, and RF transmitter and a battery. A magnet is mounted in the closure for actuating the sensor switch.

Since the antenna does not have to be accommodated within the housing, the housing can be made substantially smaller than has been possible with prior art alarm sensor unit housings. Therefore the sensor unit can be almost entirely embedded in, for example, a window sash or frame or in a small boring in a door. Consequently, the sensor unit can be so effectively concealed that it is not only unobtrusive but effectively almost invisible.

The use of a wire antenna has the further advantage that it enables the sensor unit to be designed so as to conserve power and therefore so as to require smaller batteries than have been required in prior art sensor units.

Preferably, the antenna is in the form of a flexible wire, which can be conveniently bent, as required, in order to adapt it to the frame.

The frame may be a window frame or a door frame, the closure correspondently being a window sash or a door.

The frame may, for example, be in the form of an extrusion, for example a vinyl extrusion, having a hollow interior. In that case, the wire can be positioned, during the installation of the sensor unit into the frame, so that the antenna extends longitudinally along the hollow interior of the frame.

BRIEF DESCRIPTION OF THE DRAWINGS

The present invention will be more readily understood from the following description of a preferred embodiment thereof given, by way of example, with reference to the accompanying drawings, in which.

DESCRIPTION OF THE PREFERRED EMBODIMENT

Figure 1:
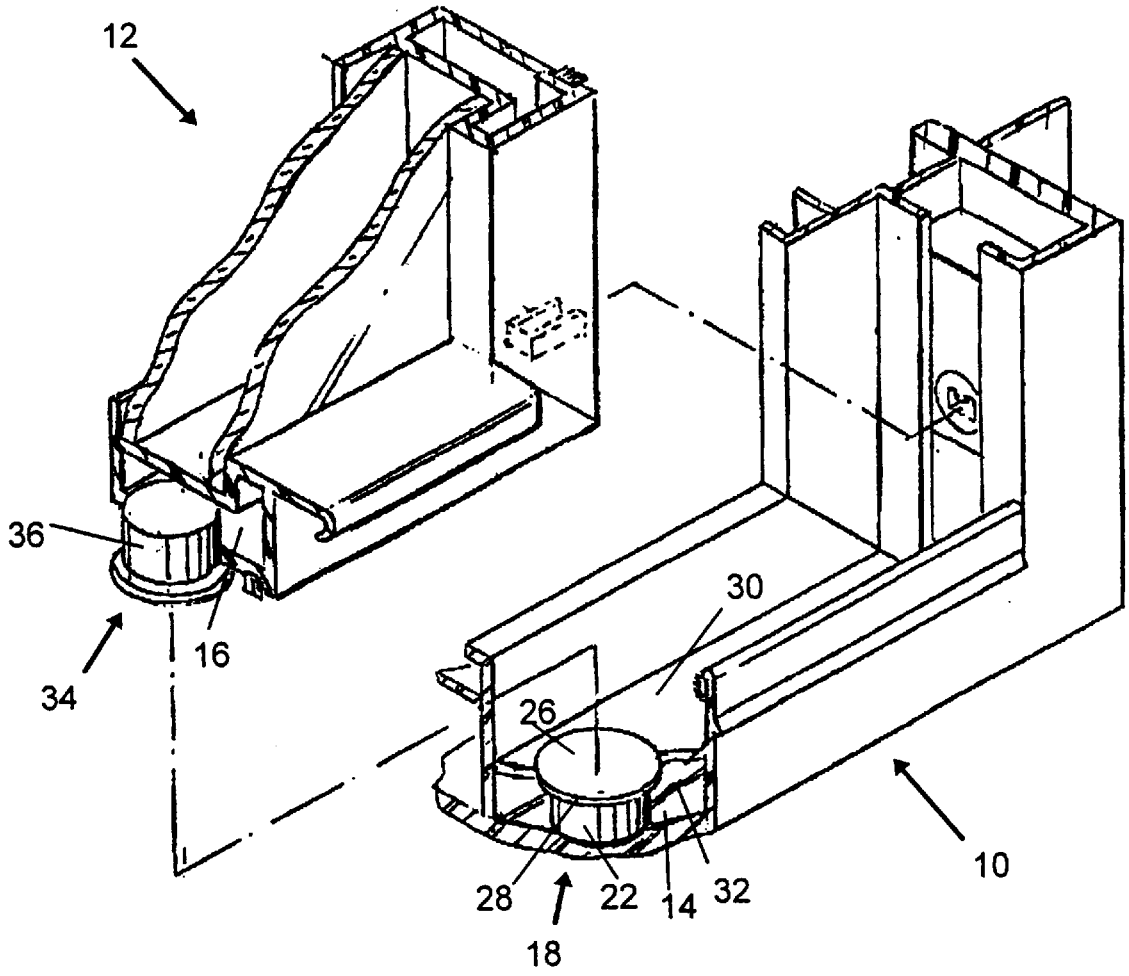
FIG. 1 shows a broken-away view, in perspective, of parts of a window frame and a window sash in which a wireless security sensor system embodying the present invention is installed.

In the accompanying drawings, reference numeral 10 indicates generally a part of a window frame defining a window opening and reference numeral 12 indicates generally a part of a window sash which is movable to and from between open and closed positions, relative to the window frame 10.

Figure 2:
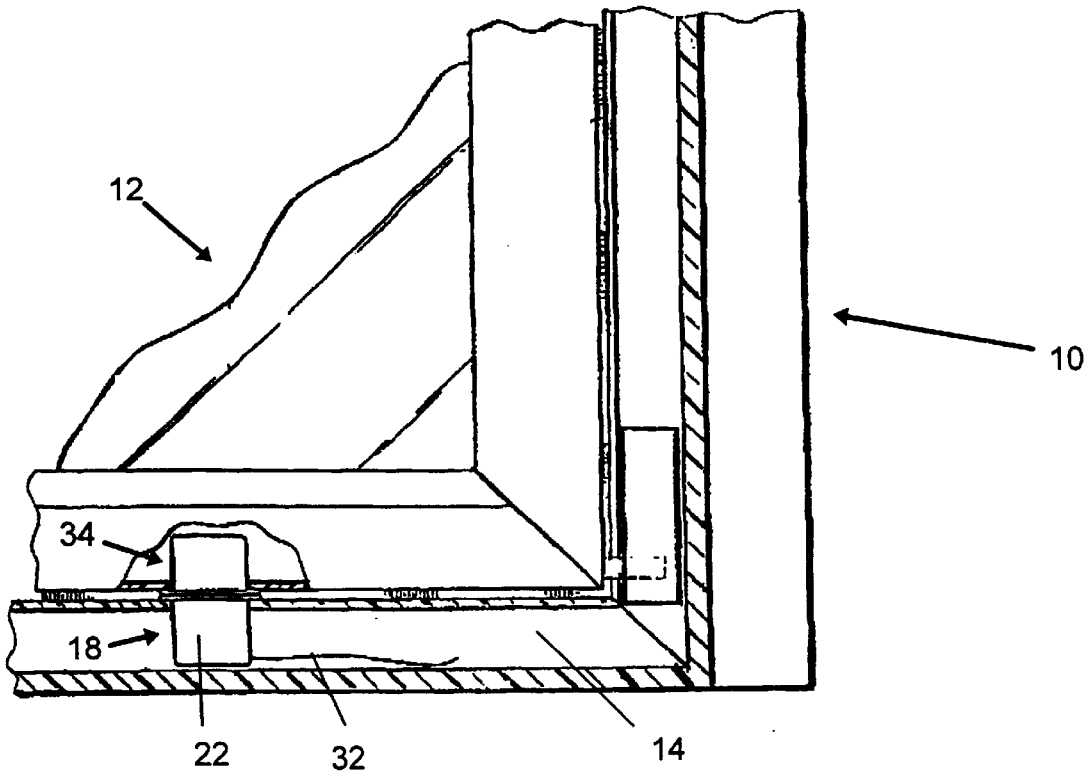
FIG. 2 shows a view in front elevation of the window sash and the window frame of FIG. 1.
Figure 3:
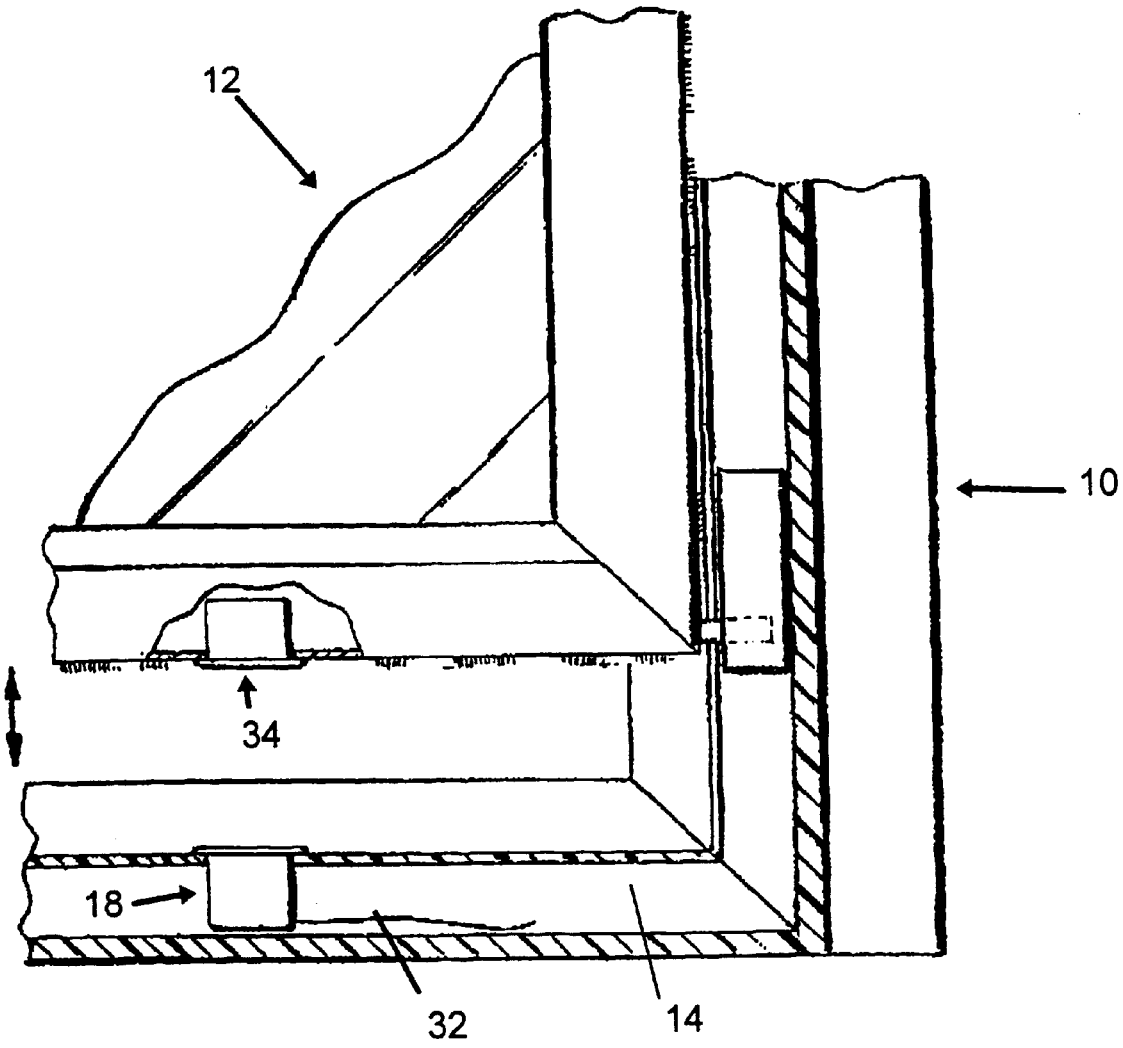
FIG. 3 shows a view in front elevation, corresponding to FIG. 2, but with the window sash moving upwardly away from its closed position relative to the window frame.

The window frame 10 is made from an extrusion of a vinyl material which, with reference in particular to FIGS. 2 and 3, has a hollow interior 14 extending along the length of the extrusion.

The window sash 12 is also formed from an extrusion of vinyl material having a hollow interior 16.

A sensor unit indicated generally by reference numeral 18 is provided in the window frame 10. The sensor unit 18 has a cylindrical housing 22 having an inner end 24 within the hollow interior 14 and an outer end 26, facing and adjacent the window opening, in the form of a disk forming a peripheral flange 28 around the cylindrical housing 22. The peripheral flange 28 is seated on an upper wall 30 of the vinyl extrusion of the window frame 10 and the inner end 24 is inserted through a circular opening in the wall 30 into the hollow interior 14. Since the flange 28 is thin, and the top or upper end of the housing 22 is therefore almost flush with the surface numeral 30, the sensor unit 18 is almost invisible when thus installed in the window frame 10. Therefore, the sensor unit 18 is accommodated in an extremely unobtrusive manner in the vinyl extrusion of the window frame 10.

Furthermore, if the sensor unit 18 is installed in the window frame 10 at a factory where the window frame is manufactured, the sensor unit 18 is protected by the window frame against damage during subsequent possible rough handling of the window frame 10 during packaging, transportation, storage, unpacking and on site installation of the window frame 10.

A ¼ wave wire antenna 32 extends from the housing 22 longitudinally along the hollow interior 14 of the window frame extrusion. The provision of the antenna 32 at the exterior of the cylindrical housing 22 substantially facilitates the objective of keeping the length of the latter extremely small. Therefore, it is possible to accommodate the sensor device 18 within the relatively shallow height of the hollow interior 14 of the window frame extrusion. Furthermore, it is consequently also possible to install the sensor unit 18 at any convenient location around the window opening.

Within the hollow interior 16 of the window sash extrusion, there is similarly embedded a magnet indicated generally by reference numeral 34, which is accommodated within a cylindrical housing 36.

Figure 4:
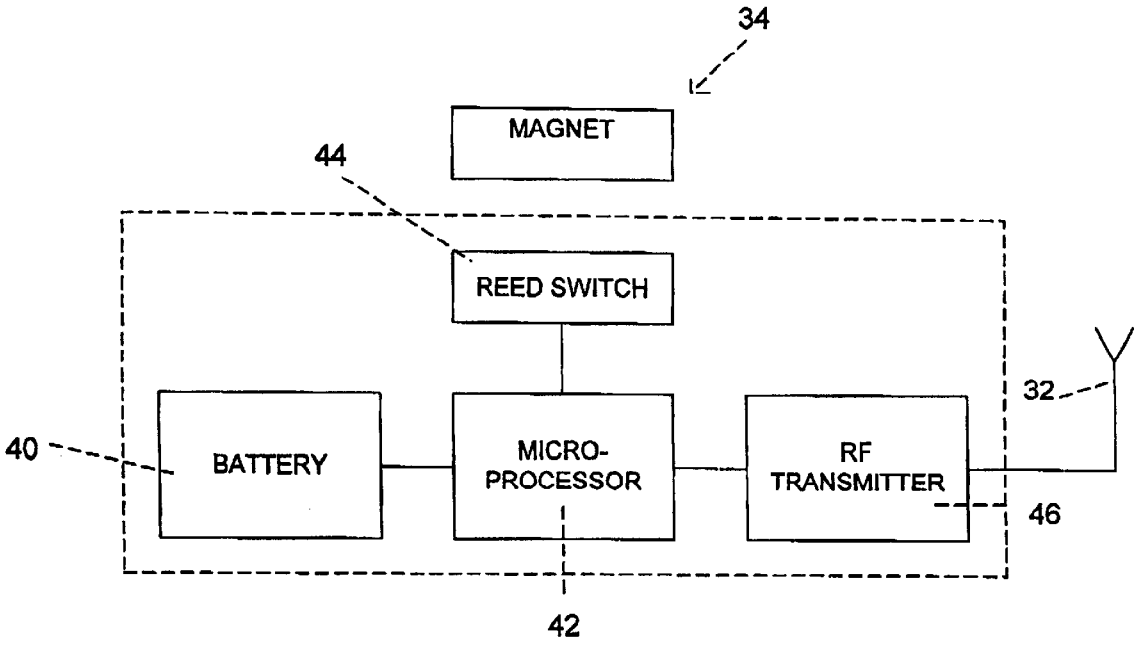
FIG. 4 shows a block diagram of the electronic components of a sensor unit embedded in the window frame of FIGS. 1 through 3.

Referring now to FIG. 4 of the accompanying drawings, which shows a block diagram of the sensor unit 18, and the magnet 54, it can be seen that the sensor unit 18 has a battery 40 for energizing a microprocessor 42, a reed switch 44 and an RF transmitter 46, which outputs a radio signal to the antenna 32. The reed switch 44 is actuated by the magnet 34, on displacement of the window sash 12 relative to the window frame 10, and in response to the actuation of the reed switch 44 the microprocessor 42 causes a signal to be transmitted by the RF transmitter 46 from the antenna 32.

Figure 5:
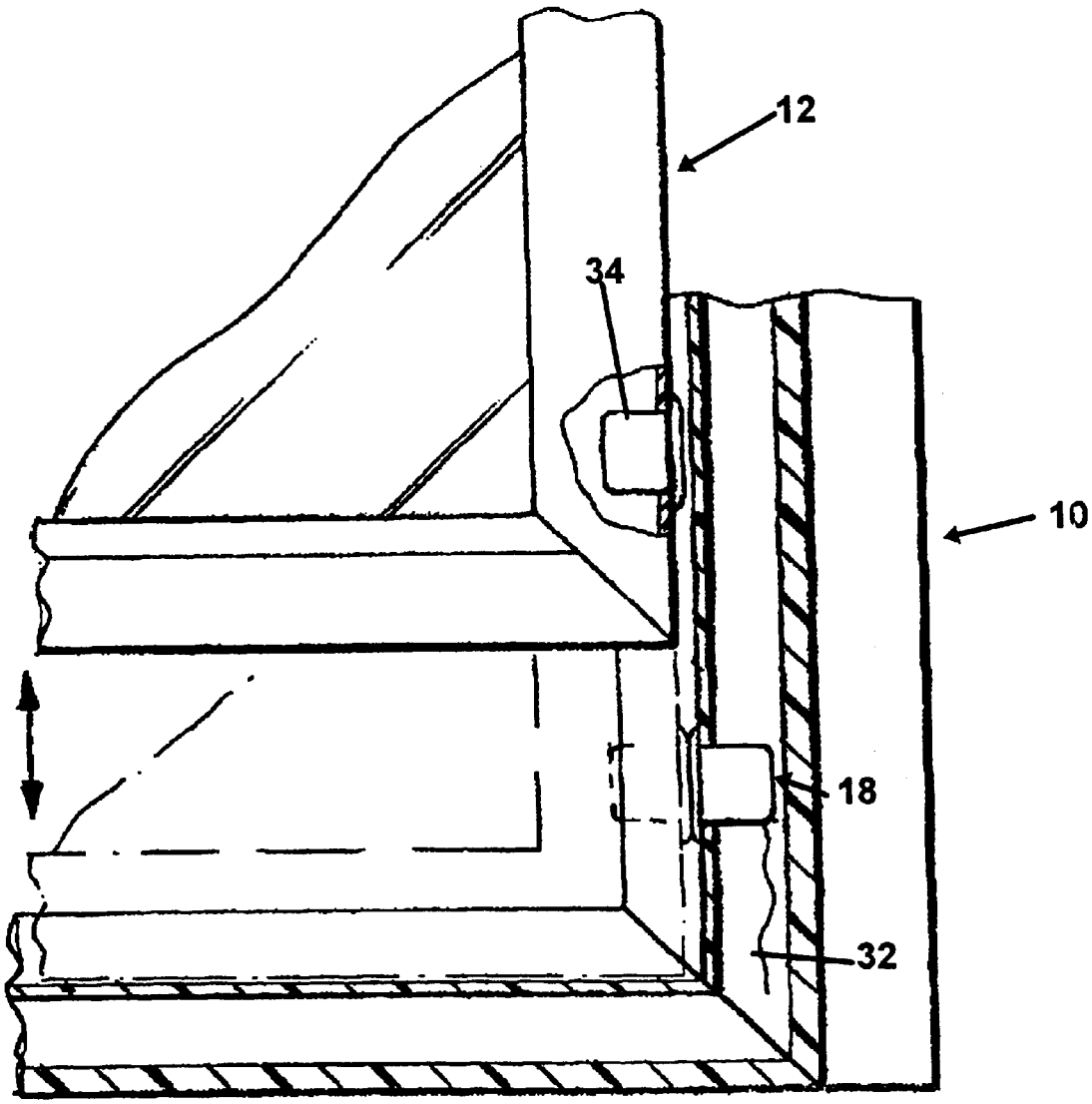
FIG. 5 shows a few in fund elevation of a window sash and a window frame, similar to that of FIG. 2, but with a sensor unit embedded in the side of the window frame.

In FIG. 5, the sensor unit 18 is shown embedded in one side of the window frame 10, instead of in the bottom of the window frame as in FIG. 2, with the wire antenna 32 extending downwardly along the interior of the window frame 10, and the magnet 34 is correspondingly embedded in an adjacent side of the window sash 12.

Figure 6:
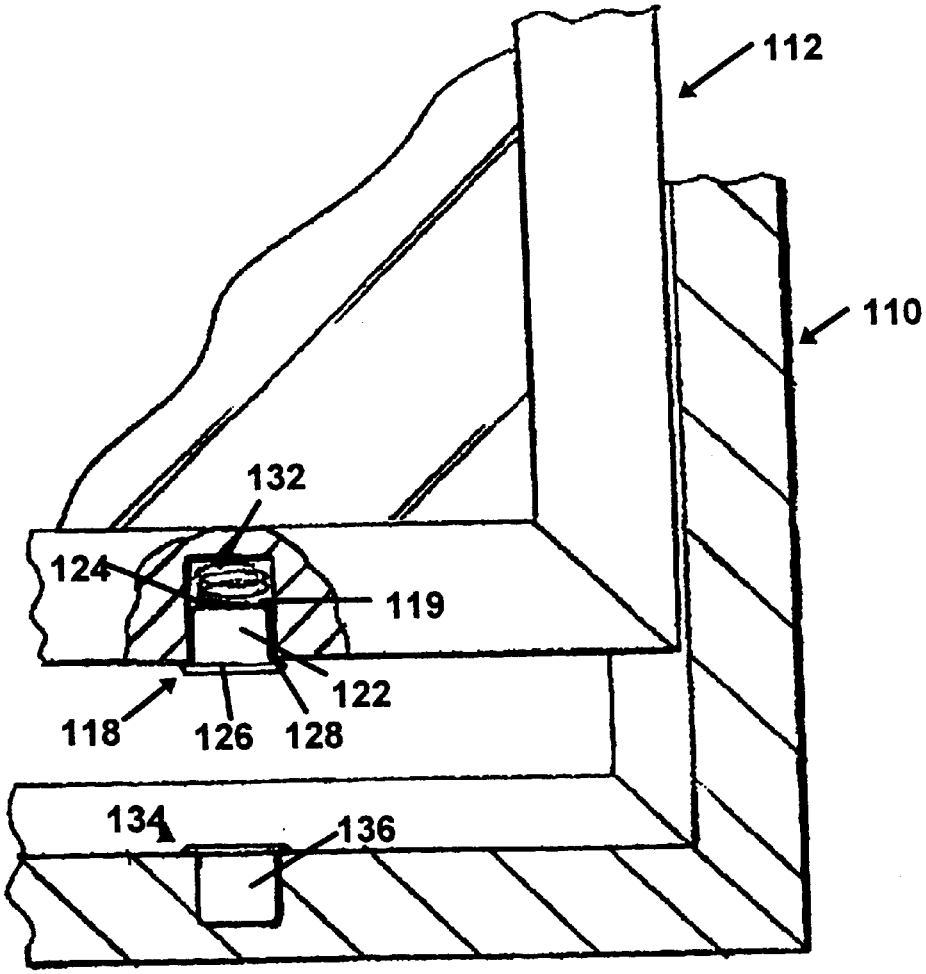
FIG. 6 shows a broken-away view in front elevation of parts of a wooden window and window frame.

In FIG. 6, parts of a window and a window frame which correspond to those of the window and window frame of FIGS. 1 to 3, have been indicated, for convenience, by corresponding reference numerals increased by 100.

FIG. 6 shows a part of a window frame indicated generally by reference to 110, and a part of a window sash indicated generally by reference 112. In this embodiment of the invention, the window frame 110 and the window sash 112 are each made of wood. A sensor unit indicated generally by reference numerals 118 is inserted into a cylindrical boring 119 in the window sash 112. Instead of being provided in the boring 119 in the window sash 112, the sensor unit 118 could alternatively be provided in a boring in the window frame 110.

The sensor unit 118 has a cylindrical housing 122 having an inner end 124 in the boring 119 and an outer end 126 in the form of a disk forming a peripheral flange 128 around the cylindrical housing 122. The peripheral flange 128 is seated on undersurface 129 of the window sash 112 and, like the flange 28 of FIG. 2, is a thin, so that the sensor unit 118 is almost invisible.

A one-quarter wave wire antenna 132 extends from the cylindrical housing 122 and, in this case, instead of extending longitudinally along the window sash 112, is loosely coiled into a helical shape and accommodated within the boring 112 above the cylindrical housing 122.

A magnet, which is indicated generally by reference numeral 134, and which is accommodated within a cylindrical housing 136, is a likewise embedded in the window frame 110.

Figure 7:
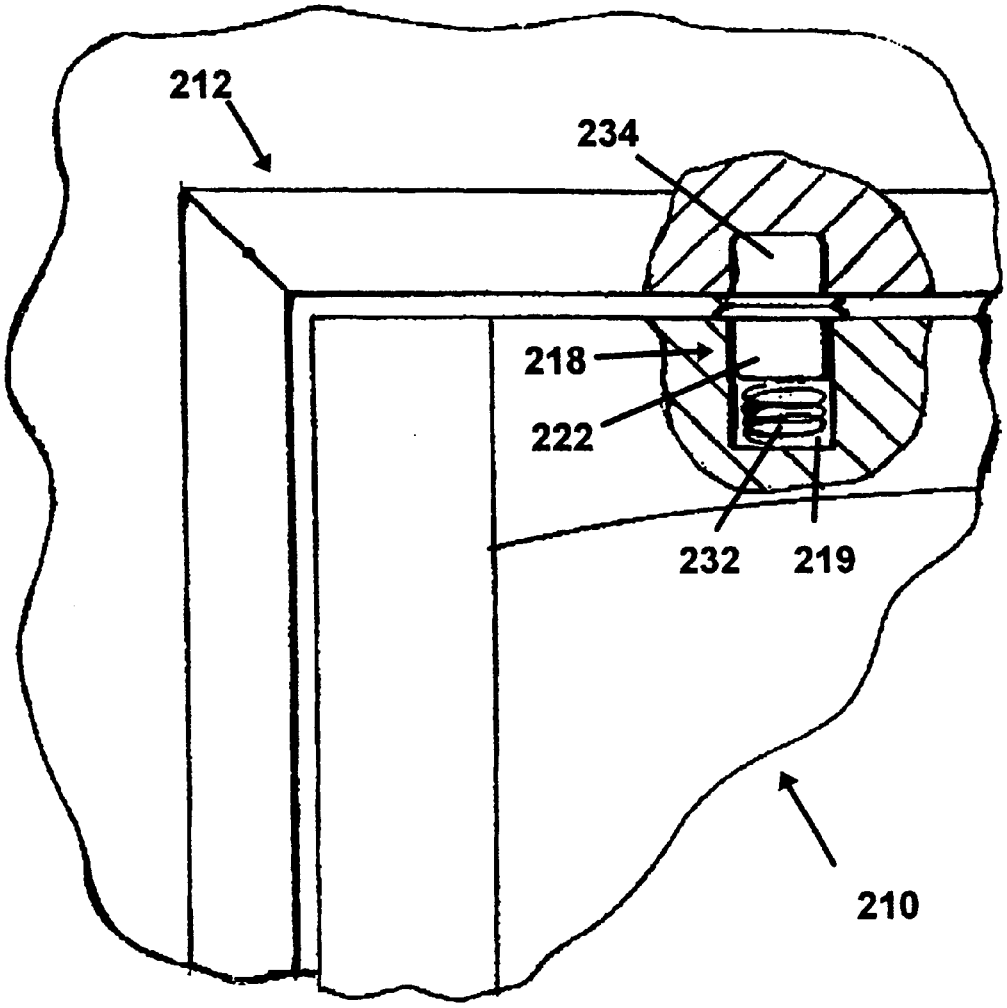
FIG. 7 shows a broken-away view, in front elevation, of parts of a wooden door and door frame.

FIG. 7 shows a broken-away view of part of a door 210 in a close position in a door frame 212. In this case, a sensor unit indicated generally by reference numeral 218 is embedded in a cylindrical boring 219 in the top of the door 210, with a wire antenna 132 extending from a cylindrical housing 222 of the sensor unit 218 in a helical fashion beneath the cylindrical housing 222 within the boring 219. A magnet 234 is embedded in the door frame 212 directly above the sensor unit 218

As will be apparent to those skilled in the art, modifications may be made to the above-described embodiments of the present invention within the scope of the invention as defined in the appended claims.

For example, if the sensor unit 18 is installed in a hole drilled in a wooden window sash or door, instead of in a hollow extrusion, the wire antenna 32 can be arranged so as to extend along a surface of the wooden sash or door. In that case, the antenna 32 can be effectively concealed by one or more coats of paint or varnish and/or by being in an inner track of the window frame.

The sensor unit and the magnet may be installed at a factory where windows, doors and their frames are manufactures or may be installed by window and door dealers or on installation of windows and door in their buildings.

What is claimed is:

1. A wireless security sensor system, comprising:

a window frame formed of an extrusion, said window frame having an exterior surface and an interior surface with a hollow interior therebetween defining a window opening;

a window sash in the window opening, the window sash having a peripheral exterior surface and being movable relative to the window frame between open and closed positions;

a sensor unit having a first end embedded within the frame, wherein the sensor unit is positioned within the hollow interior, and the sensor unit further includes a second end opposite from the first end, the second end facing the opening and being generally flush with the interior surface of the frame;

the sensor unit including an antenna extending along the hollow interior of the extrusion, a sensor switch, a microprocessor, a wireless transmitter and a power source; and the wireless security sensor system including a magnet assembly mounted within the window sash for actuating the sensor switch, said magnet assembly including a first end that is embedded within the sash and a second end that faces toward the second end of the sensor unit when the window sash is moved into the closed position relative to the window frame, said second end being generally flush with the peripheral exterior surface of the sash.

2. A wireless security system as claimed in claim 1, wherein the housing has a peripheral flange at said opposite end thereof, the peripheral flange being seated on the surface of the window flange.

3. A wireless security sensor system as claimed in claim 1, wherein the wire antenna comprises a ¼ wave wire antenna.

4. A wireless security sensor system, comprising:

a window frame having an exterior surface and an interior surface with a hollow interior therebetween defining a window opening;

a window sash having a peripheral exterior surface within the window opening, the window sash being movable relative to the window frame between open and closed positions;

a sensor unit having a first end embedded within either the window frame or the window sash and a second end of the sensor unit opposite from the first end, the second end facing the opening such that the second end is nearly flush with its respective interior surface of the frame or peripheral exterior surface of the sash relative to the adjacent opening;

the sensor unit including an antenna, a sensor switch, a microprocessor, a wireless transmitter and a power source; and the wireless security sensor system including a magnet assembly for actuating the sensor switch mounted within the window sash or window frame that does not contain the sensor, said magnet assembly further includes an end surface that is exposed to the opening and is aligned with the second end of the sensor unit when the sash is moved relative to the window frame in the opened position and that such end surface of the magnet assembly is nearly flush with respective peripheral exterior surface of the sash or the interior surface of the frame.

5. A wireless security sensor system, comprising:

a pair of members;

the members comprising a frame having a first exterior surface and second interior surface with a hollow interior therebetween defining an opening and a closure having a peripheral exterior surface movable relative to the frame between open and closed positions, the closure closing the opening in the closed position;

a sensor unit embedded in the hollow interior of the frame;

the sensor unit including a housing and the housing having an inner end thereof within the hollow interior of the frame and an outer end thereof facing the opening, said outer end being oriented toward the opening and terminates near the second interior surface such that the outer end is nearly flush with the second interior surface;

the sensor unit further including an antenna extending from the housing along the hollow interior of the frame;

the housing containing a sensor switch, a microprocessor, a wireless transmitter connected to the antenna and a power source; and a magnet assembly having a first end and a second end mounted in the closure for actuating the sensor switch; said first end of the magnet assembly being embedded within the closure with the second end oriented toward the opening and nearly flush with peripheral exterior surface;

wherein the outer end of the sensor housing embedded in the frame and the second end of the magnet assembly embedded in the closure are facing each other when the closure closes the opening.

6. A wireless security sensor system as claimed in claim 5, wherein the frame is formed from an extrusion having a hollow interior, and the wire antenna extends along the hollow interior of the extrusion.

7. A wireless security sensor system as claimed in claim 6, wherein the wire antenna is a ¼ wave wire antenna.

8. A wireless security sensor system as claimed in claim 5, wherein a further opening is formed in a surface of the frame facing the first-mentioned opening, and the housing is inserted into the further opening.

9. A wireless security sensor system as claimed in claim 8, wherein the housing has a peripheral flange at the outer end thereof, the peripheral flange being seated on said surface of the frame.

10. A wireless security sensor system as claimed in claim 5, wherein the frame is formed of a plastic material extrusion having a hollow interior, and the outer end of the housing has peripheral flange seated on the frame.

11. A wireless security sensor system as claimed in claim 5, wherein the frame comprises a window frame and is formed of a plastic extrusion having a hollow interior, and the sensor unit has a first end adjacent the opening and a second end which is opposite from the first end and which is located within the hollow interior.

12. A wireless security sensor system as claimed in claim 11, wherein the antenna extends along the hollow interior of the extrusion.

13. A wireless security sensor system as claimed in claim 5, wherein the frame comprises a window frame and is formed of a plastic extrusion having a hollow interior, and the sensor unit has a first end adjacent the opening, the remainder of the housing being within the hollow interior of the extrusion.

* * * * *